United States Patent [19]

Fabian

[11] 4,020,510

[45] May 3, 1977

[54] HOSPITAL BED READING AND WRITING DEVICE

[76] Inventor: Ralf Fabian, 634 Cedar St., Mamaroneck, N.Y. 10543

[22] Filed: Sept. 2, 1975

[21] Appl. No.: 609,553

Related U.S. Application Data

[63] Continuation of Ser. No. 473,353, May 28, 1974, abandoned.

[52] U.S. Cl. ..... 5/332; 5/85

[51] Int. Cl.[2] ..... A47B 83/04; A47C 21/00

[58] Field of Search ..... 5/72, 81, 84, 85, 329–332

[56] References Cited

UNITED STATES PATENTS

| | | | |
|---|---|---|---|
| 866,522 | 9/1907 | Scanlon | 5/332 |
| 1,590,726 | 6/1926 | Gorsgren | 5/332 |
| 1,797,847 | 3/1931 | Vandagriff | 5/332 |
| 2,710,975 | 6/1955 | Stoen et al. | 5/84 |

*Primary Examiner*—Casmir A. Nunberg
*Attorney, Agent, or Firm*—Allen D. Brufsky

[57] ABSTRACT

A hospital bed accessory for supporting a desk-like platform within reach of a patient, especially one who has to lie prone on the bed, so that he himself can reach it and read or write thereon, and move it out of the way, the accessory including a vertical main post clamped to the headboard of the bed, and a horizontal radial arm extending out from the main post over the bed. A depending second post is suspended from the outer end of the radial arm so as to bring the desk-like platform suspended from its lower end to convenient reach of the patient. Clips are provided on the desk-like platform for holding writing and reading materials thereon.

5 Claims, 3 Drawing Figures

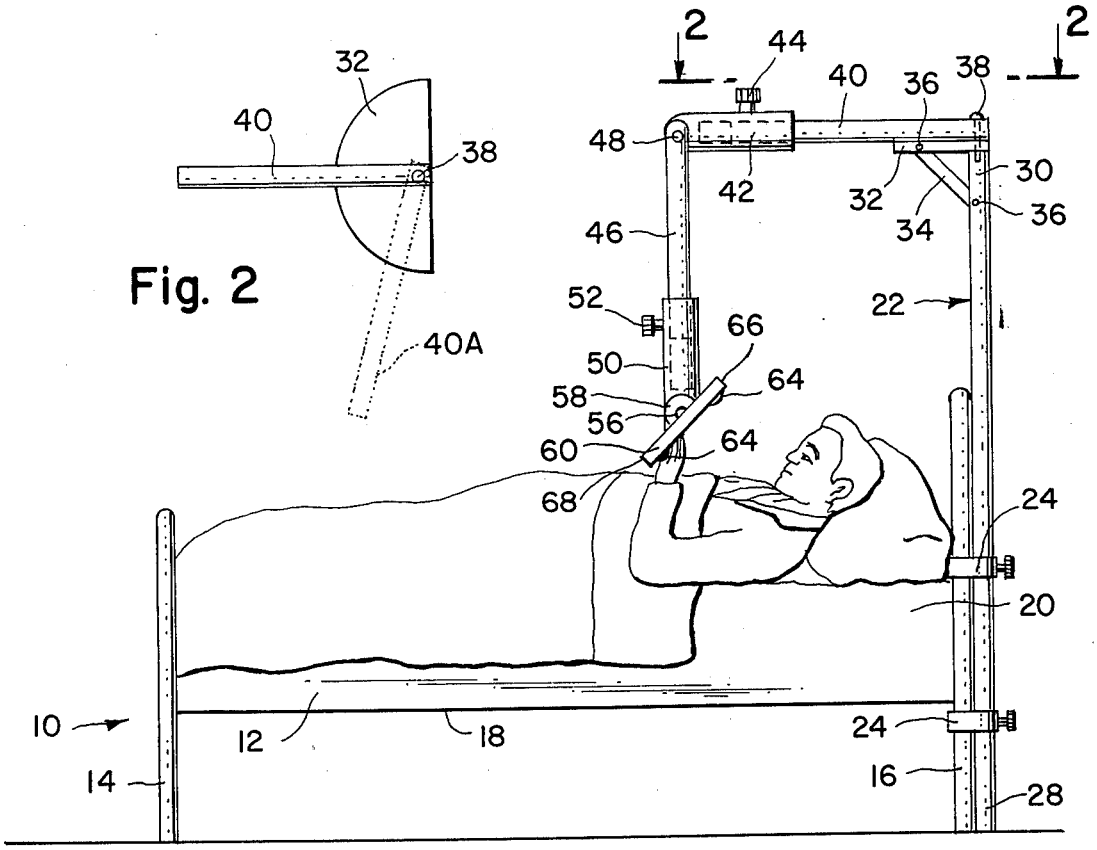
Fig. 2
Fig. 1
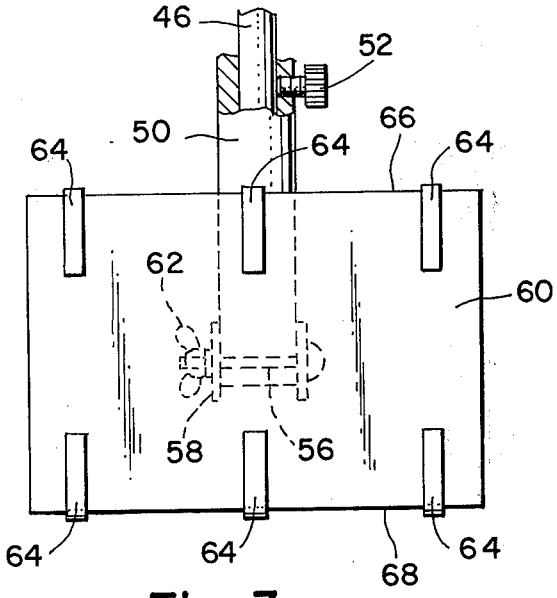
Fig. 3

HOSPITAL BED READING AND WRITING DEVICE

This application is a continuation of Ser. No. 473,353, filed May 28, 1974, now abandoned.

SUMMARY OF THE INVENTION

This invention relates to improvements in accessories and attachments for hospital beds which enable a patient lying in a bed to read and write even while in a prone position.

An object of the invention is to provide a new and novel device for use in connection with a hospital bed whereby the patient in the bed is enabled by himself to read and to write without aid.

Another object of the invention is to provide a new and novel device which may be attached to a hospital or other patient's bed which will bring within reach a convenient desklike writing board with means thereon for supporting it by attachment to the bed, and including fastening clips for holding reading and writing materials onto the writing board so that the patient can easily and conveniently use it for reading and writing thereon without rising from a prone position.

A further object of the present invention is to provide a new and novel bedroom accessory for attachment to the hospital bed for making it easy for the patient to both read and write, and which is so constructed that it is not in the way of a doctor or nurse for examination or giving of medicine, and also is not in the way of the attendant for feeding of the patient.

Still another object of the present invention is to provide a new and novel bedroom accessory in which there are support elements for engagement with the frame of the bed, and which are made up of very few parts which are strong and rugged in construction, and easily adjustable to bring the writing board into comfortable reach of the patient regardless of whether he or she is lying prone on the bed or in some other position.

A further object of the present invention is to provide a new and novel bedroom accessory of the type described which is simple in construction and which can be made at low cost either by hand or by mass production methods.

BACKGROUND OF THE INVENTION

In connection with the use of hospital beds, in private rooms, wards and in the bedrooms of private homes, it frequently happens that due to some injury the patient is unable to sit up, or event to partially leave the prone or reclining position. This may occur where there is a severe spinal injury or where the patient is placed in traction following an accident, and cannot and should not sit up. Other similar situations will be encountered, yet the patient will if conscious desire to read a paper or book, or write something such as a letter and the present invention seeks to make it as easy as possible for him to do so without any strain and with convenience.

BRIEF DESCRIPTION OF THE DRAWINGS

The above and other objects, features and advantages of the present invention will become apparent from the following description of the accompanying drawings, wherein:

FIG. 1 is a side elevational view of the bedroom reading and writing accessory device as used in connection with a hospital bed and opened out into extended position for use by the patient;

FIG. 2 is a top plan detail view taken on viewing plane 2—2 of FIG. 1; and

FIG. 3 is an elevational view of the adjustable reading and writing board and its immediate supports, as best seen from the viewing plane of the patient in the bed.

BRIEF DESCRIPTION OF THE PREFERRED EMBODIMENTS

In order to understand clearly the nature of the present invention and the best means for carrying it out, reference may be had to the drawings, in which like numerals denote similar parts throughout the several views.

As shown, there is a bed 10 with side rails 12 interconnecting the footboard portion 14 and the headboard portion 16, so that a bedspring 18 may be supported thereon with a mattress 20 on the bedspring. The bed may be a regular hospital bed in which a crank is used to tilt the head portion of the bed upwards and another crank may be used to elevate the lower portions such as under the legs, knees or hips to various angular positions, depending upon the condition of the patient and the care and treatment involved.

On the other hand, the bed may be an ordinary bed as is used in the home, where the patient is living and getting home bed-rest and care, outside of the hospital. In any event, the present invention provides an upright main support post 22, which may be made of hollow piping or tubing, such as iron or aluminum, and clamps 24 are provided for securing the support post 22 to the headboard 16. Where the headboard is made of tubular iron or brass piping, then the clamps will be made to fit accordingly. where the headboard is made of wood or panelling, then the clamps will still be made in a suitable manner so as to hold the main upright post 22 to the headboard.

It is preferable for the lower end 28 of the support post 22 to reach right down to the floor for good and firm support and avoidance of slippage. Thus, event if a clamp is accidentally not tightened enough or comes loose, there is no danger of the entire device coming down and landing onto the patient in the bed, as has happened in the past. The upright main support post 22 extends upwardly to a substantial height, with its upper support platform 32, which is also supported in a horizontal position by means of an angular bracket strut arm 34 which is secured by screws or bolts 36 to the upright post 22 and the platform 32.

As best seen in FIG. 2, the upper support platform 32 is preferably semicircular in shape, with a vertical pivotal holding pin 38 or bolt extending through the horizontal radial arm 40 and through the platform 32 with a nut threaded therebelow, to hold the radial arm 40 securely to the platform, while at the same time permitting it to be swung both ways, left and right, angularly about the axis of the pin 38 as shown in broken lines at 40A. A sleeve member 42 is carried on the outer end portion of the radial arm 40, and is adjustable in position by the set-screw 44 which may have a wing nut for easy hand tightening.

A vertical arm 46 is pivotally secured by pivot pin 48 to the outer end of the sleeve member 42 and hangs downwardly as shown, being engaged with a sleeve member 50 to which it is secured adjustably by means of a set screw 52 which may be provided with a wing-nut head for easy hand tightening. The sleeve member 50 has a horizontal shaft 56 extending through a yoke member 58, which is carried by the rear main desk wall or platform 60 with a wing nut 62 threaded on one end of the shaft for tightening up the yoke and shaft to the sleeve member 50 for adjusting the angularity of the desk wall 60 to suit the patient. Use of wing nuts for all set screws is recommended to permit hand tightening rather than the use of tools therefor.

Spring clips 64 may be provided along the upper and lower edges 66 and 68 of the desk board 60 to hold papers, books or the like thereon for reading or writing. Where the desk board 60 is formed of ferrous metal such as sheet iron or steel, then small magnets may be used to hold the papers in place on the board 60. If the patient is in any way artistically inclined, he or she may want to place one or more sheets of drawing paper or bristol board on the desk board 60 or even a piece of canvas for making sketches or painting thereon. A patient who is thus confined to bed, should be afforded every opportunity to endure the tedium of lying in bed and hence, he should be helped in every way. Thus, for example, he may want to compose music, or sing from music sheets, and these may all be mounted on the desk board 60 if desired.

While the preferred embodiments of the invention have herein been shown and described, it will be apparent to those skilled in the art that there are many modifications, changes and improvements which may be made therein without departing from the spirit and scope of the invention.

What is claimed is:

1. A bed accessory device for use with a bed on a horizontal support surface when occupied by a pateint and the like, comprising:

upright main post means, main fastening means for fastening said main post means to a rear frame portion of said bed with the lower end of said upright main post means in engagement with said horizontal support surface, horizontal arm means carried by said main post means and extensible therefrom, said horizontal arm means being elevationally disposed above the patient, depending second post means disposed above the patient and carried by said horizontal arm means, a desk member carried by said second post means to a location near said patient for affording a reading and writing surface for use by said patient, support yolk means for said desk member, adjustment sleeve means carried by said support yolk means and adjustably engageable with the lower portion of said second post means for regulating and adjusting the vertical elevation of said desk member relative to the patient, and pivot means carried jointly by said support yolk means and said desk member for adjusting the angle of said desk member relative to a horizontal plane and to the patient for convenient positioning for the patient to employ said desk member for reading and writing thereon.

2. The construction of claim 1, wherein said main fastening means comprises at least one main bed clamp for engaging both said upright main post means and a rear frame portion of said bed for cosecurement thereof with said main post means in an upright vertical position.

3. The construction of claim 1, comprising upper support platform means carried by said main post means at its upper end portion, strut means connected from said main post means to an outer portion of said upper support platform means for maintaining said support platform means in a horizontal position, and said horizontal arm means being supported on said platform means and capable of angular swinging movement thereon throughout an arc of about 180°.

4. The construction of claim 1, comprising first radial adjustment sleeve means carried by said horizontal arm means and secured pivotally to said second post means, said radial adjustment sleeve means being capable of adjusting the radial distance of said second post means from said main post means and serving to bring said desk member into a convenient position relative to said patient.

5. The construction of claim 1, comprising a plurality of clipping fastening means carried by said desk member for releasable holding thereto of any paper, books, reading and writing materials for use by the patient in such activities.

* * * * *